US011501634B2

(12) United States Patent
Takegoshi et al.

(10) Patent No.: US 11,501,634 B2
(45) Date of Patent: Nov. 15, 2022

(54) INFORMATION MANAGEMENT APPARATUS, VEHICLE, AND METHOD

(71) Applicant: HONDA MOTOR CO., LTD., Tokyo (JP)

(72) Inventors: Katsuya Takegoshi, Tokyo (JP); Satoshi Nishimiya, Tokyo (JP); Hiroki Muta, Tokyo (JP); Teruki Hatano, Tokyo (JP); Yoshimi Watanabe, Tokyo (JP); Hibiki Koga, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/161,825

(22) Filed: Jan. 29, 2021

(65) Prior Publication Data

US 2021/0150887 A1 May 20, 2021

Related U.S. Application Data

(63) Continuation of application No. PCT/JP2018/029242, filed on Aug. 3, 2018.

(51) Int. Cl.
*G08G 1/01* (2006.01)
*G08G 1/123* (2006.01)

(52) U.S. Cl.
CPC ..... *G08G 1/0104* (2013.01); *G08G 1/0129* (2013.01); *G08G 1/123* (2013.01)

(58) Field of Classification Search
CPC .... G08G 1/0104; G08G 1/0129; G08G 1/123; G08G 1/0145; G08G 1/096741; G08G 1/096791; G08G 1/205; G08G 1/096725; G07C 5/008; G07C 5/0808
See application file for complete search history.

(56) References Cited

U.S. PATENT DOCUMENTS 6,326,704 B1 * 12/2001 Breed ..... G07C 5/0808 340/12.32
7,092,803 B2 8/2006 Kapolka et al.
8,306,731 B2 11/2012 Waggaman, III
(Continued)

FOREIGN PATENT DOCUMENTS

JP H01-131982 A 5/1989
JP 2001-61185 A 3/2001
(Continued)

OTHER PUBLICATIONS

Extended European Search Report for European Patent Application No. 18928226.2 dated Jul. 14, 2021.
(Continued)

*Primary Examiner* — Joseph H Feild
*Assistant Examiner* — Rufus C Point
(74) *Attorney, Agent, or Firm* — Thomas | Horstemeyer, LLP

(57) ABSTRACT

The present invention is an information management apparatus, capable of communicating with a plurality of vehicles, the apparatus comprising a receiving unit for receiving information indicating an occurrence of a failure in one vehicle of the plurality of vehicles, from the one vehicle, and a transmission unit for transmitting information based on the failure to the other vehicles of the plurality of vehicles, thereby, a recurrence of a similar failure in a predetermined region can be appropriately prevented.

11 Claims, 7 Drawing Sheets

(56) References Cited

U.S. PATENT DOCUMENTS

| | | | | |
|---|---|---|---|---|
| 8,437,901 | B2 | 5/2013 | Anderson | |
| 8,639,408 | B2 | 1/2014 | Anderson | |
| 9,432,197 | B2 | 8/2016 | Naganuma et al. | |
| 9,635,518 | B2 | 4/2017 | Lee et al. | |
| 9,922,558 | B2 | 3/2018 | Tanaka et al. | |
| 10,536,827 | B2 | 1/2020 | Lee et al. | |
| 10,891,856 | B1 * | 1/2021 | Graham | G08G 1/205 |
| 2002/0188392 | A1 * | 12/2002 | Breed | B60N 2/0276 701/45 |
| 2002/0198894 | A1 * | 12/2002 | Tamura | G06Q 30/02 |
| 2003/0009271 | A1 * | 1/2003 | Akiyama | H04L 69/329 701/29.6 |
| 2003/0110482 | A1 * | 6/2003 | Ferguson | G06F 8/65 717/174 |
| 2004/0138790 | A1 | 7/2004 | Kapolka et al. | |
| 2004/0193348 | A1 * | 9/2004 | Gray | G05D 1/0219 701/50 |
| 2005/0038581 | A1 | 2/2005 | Kapolka et al. | |
| 2005/0075784 | A1 * | 4/2005 | Gray | A01B 69/008 701/25 |
| 2008/0294690 | A1 | 11/2008 | McClellan et al. | |
| 2010/0094481 | A1 | 4/2010 | Anderson | |
| 2010/0094499 | A1 * | 4/2010 | Anderson | G05D 1/0295 700/13 |
| 2010/0094687 | A1 | 4/2010 | Waggaman, III | |
| 2012/0311340 | A1 | 12/2012 | Naganuma et al. | |
| 2014/0257911 | A1 * | 9/2014 | Anderson | G06Q 10/06315 705/7.25 |
| 2015/0206104 | A1 * | 7/2015 | Suzuki | G06Q 50/10 705/305 |
| 2016/0093216 | A1 | 3/2016 | Lee et al. | |
| 2016/0117871 | A1 | 4/2016 | McClellan et al. | |
| 2017/0101054 | A1 * | 4/2017 | Dusane | G08G 1/096741 |
| 2017/0132924 | A1 | 5/2017 | Tanaka et al. | |
| 2017/0228945 | A1 | 8/2017 | Lee et al. | |
| 2017/0324817 | A1 * | 11/2017 | Oliveira | H04L 67/52 |
| 2018/0005132 | A1 * | 1/2018 | Singh | G05B 23/0283 |
| 2020/0196121 | A1 | 6/2020 | Lee et al. | |

FOREIGN PATENT DOCUMENTS

| | | | |
|---|---|---|---|
| JP | 2001-328457 | A | 11/2001 |
| JP | 2010-266925 | A | 11/2010 |
| JP | 2014-63240 | A | 4/2014 |
| JP | 2014-82790 | A | 5/2014 |
| JP | 2016-217777 | A | 12/2016 |
| JP | 2017-91265 | A | 5/2017 |
| JP | 2017-182490 | A | 10/2017 |
| WO | 03/077205 | A2 | 9/2003 |
| WO | 03/077205 | A3 | 9/2003 |
| WO | 2020/026437 | A1 | 2/2020 |

OTHER PUBLICATIONS

R. W. Gunderson et al, The collective: GIS and the Computer-Controlled Farm, Geospatial Solutions, Oct. 1, 2000, p. 30, vol. 10, No. 10, www.geospatial-online.com.

Chrpa Lukas et al, Mixed-Initiative Planning, Replanning and Execution: From Concept to Field Testing using AUV Fleets, 2017 IEEE/RSJ International Conference on Intelligent Robots and Systems (IROS), IEEE, Sep. 24, 2017, pp. 6825-6830.

International Search Report and Written Opinion for PCT/JP2018/029242 dated Nov. 6, 2018.

* cited by examiner

INFORMATION MANAGEMENT APPARATUS, VEHICLE, AND METHOD

CROSS-REFERENCE TO RELATED APPLICATION(S)

This application claims priority to and the benefit of PCT/JP2018/029242 filed on Aug. 3, 2018, the entire disclosure of which is incorporated herein by reference.

TECHNICAL HELD

The present invention mainly relates to an information management apparatus that manages information between vehicles.

BACKGROUND ART

If some failure occurs in a vehicle, e.g., if an unforeseen movement that does not follow a driving operation occurs, the cause thereof needs to be investigated. As an example of a method for investigating the cause, it is conceivable to provide a vehicle with a memory for recording vehicle movement history, driving operation history, or the like and analyzing the content recorded in this memory (see Patent Document 1). However, to ensure safety for the user, it is also often required to promptly/provisionally prevent an occurrence (recurrence) of a similar failure before investigating the cause.

CITATION LIST

Patent Literature

PTL1: Japanese Patent Laid-Open No. 1-131982

SUMMARY OF INVENTION

Technical Problem

The present invention aims to prevent a recurrence of the aforementioned failure with a relatively simple configuration.

Solution to Problem

One aspect of the present invention relates to an information management apparatus, and the information management apparatus includes: a receiving unit for receiving information indicating an occurrence of a failure in one vehicle of the plurality of vehicles, from the one vehicle; and a transmission unit for transmitting information based on the failure to the other vehicles of the plurality of vehicles.

Advantageous Effects of Invention

According to the present invention, a recurrence of a failure can be appropriately prevented.

DESCRIPTION OF EMBODIMENTS

Figure 1A:
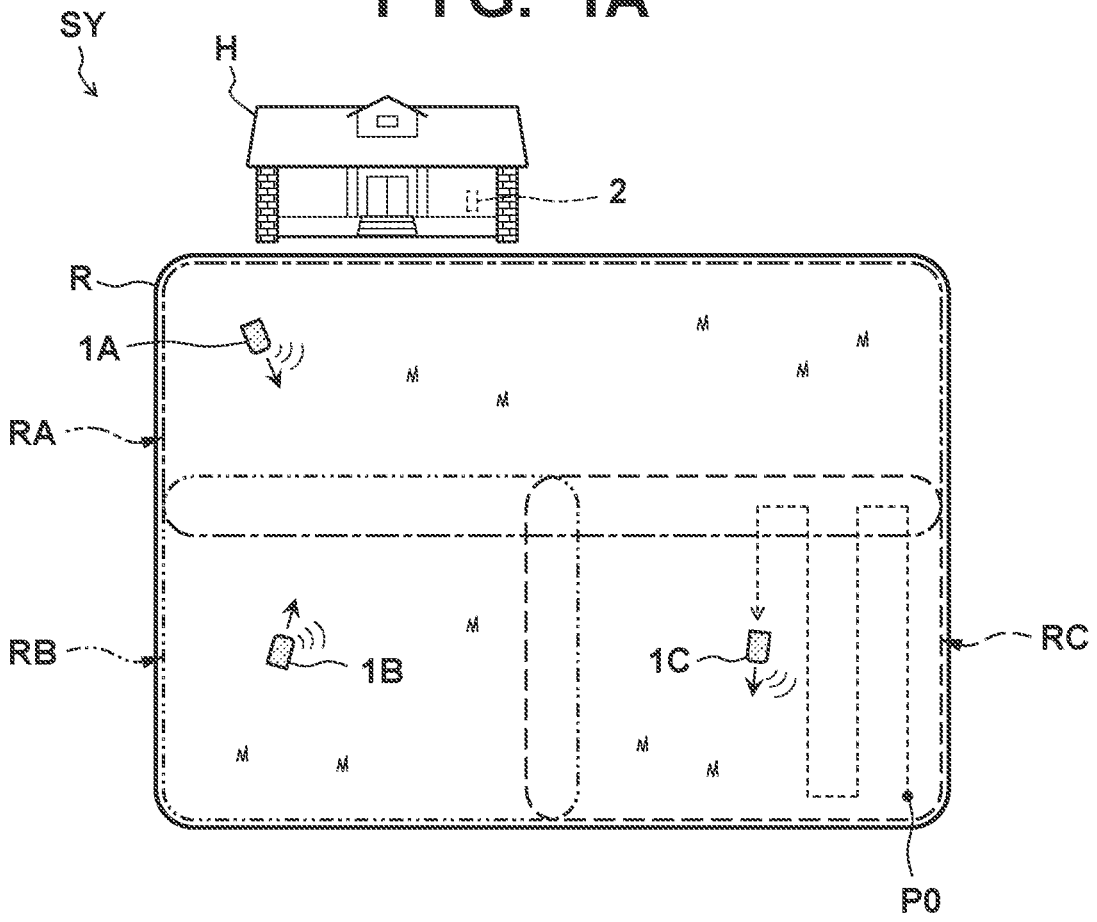
FIG. 1A is a schematic diagram for illustrating an example configuration of a work system.

Hereinafter, embodiments of the present invention will be described with reference to the attached drawings. Note that the diagrams are schematic diagrams showing structures or configurations of the embodiments, and the dimensions of each member shown in the diagrams do not necessarily reflect the real dimensions. In the diagrams, the same elements are assigned the same reference numerals. In the present specification, description of redundant content is omitted.

First Embodiment

Figure 1B:
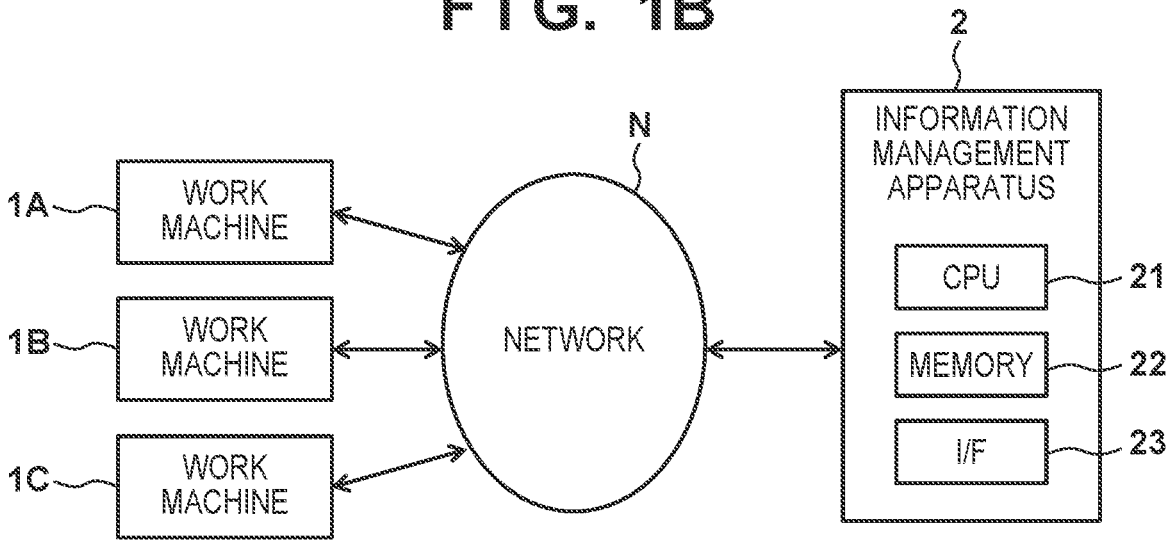
FIG. 1B is a block diagram for illustrating an example configuration of the work system.

FIG. 1A is a schematic diagram showing an example configuration of a work system SY according to the first embodiment, and a work mode thereof. FIG. 1B is a block diagram showing an example configuration of the work system SY. The work system SY includes a plurality of work machines (work vehicles) 1A, 1B, and 1C, and an information management apparatus (server) 2.

Each of the plurality of work machines 1A to 1C includes a working unit for performing predetermined work, and the work machines 1A to 1C perform work together in a predetermined work region R. To simplify the description, three work machines 1A to 1C are described here as an example. However, the number of work machines may be two, or may be four or more, and is not limited to this example. Note that, in the following description, the work machines 1A to 1C are simply referred to as "work machine (s) 1" in some cases when they are not particularly distinguished.

The information management apparatus 2 includes a central processing unit (CPU) 21, a memory 22, and an external communication interface 23, and is configured to be able to communicate with the plurality of work machines 1A to 1C via a network N and process information associated therewith. It is assumed in this embodiment that the information management apparatus 2 is installed in a house H of an owner of the work region R, but the information management apparatus 2 may alternatively be installed at a location relatively far from the work region R as another embodiment.

The plurality of work machines 1A to 1C are assigned respective regions RA to RC in which the work machines 1A to 1C are to work in the work region R. Here, the work machine 1A is assigned an assigned region RA, the work machine 1B is assigned an assigned region RB, and the work machine 1C is assigned an assigned region RC. It is favorable that the assigned regions RA to RC overlap each other at their boundary portions such that there is no region where the work is not performed.

For example, the work machine 1C starts the work from a work start point P0 in the assigned region RC and performs the work over the entire assigned region RC while moving back and forth in predetermined directions, as indicated by a broken line arrow. Accordingly, the assigned region RC can also be expressed as a scheduled-travel region in which the work machine 1C is scheduled to travel. The same applies to the work machines 1A and 1B and the assigned regions RA and RB.

Figure 2A:
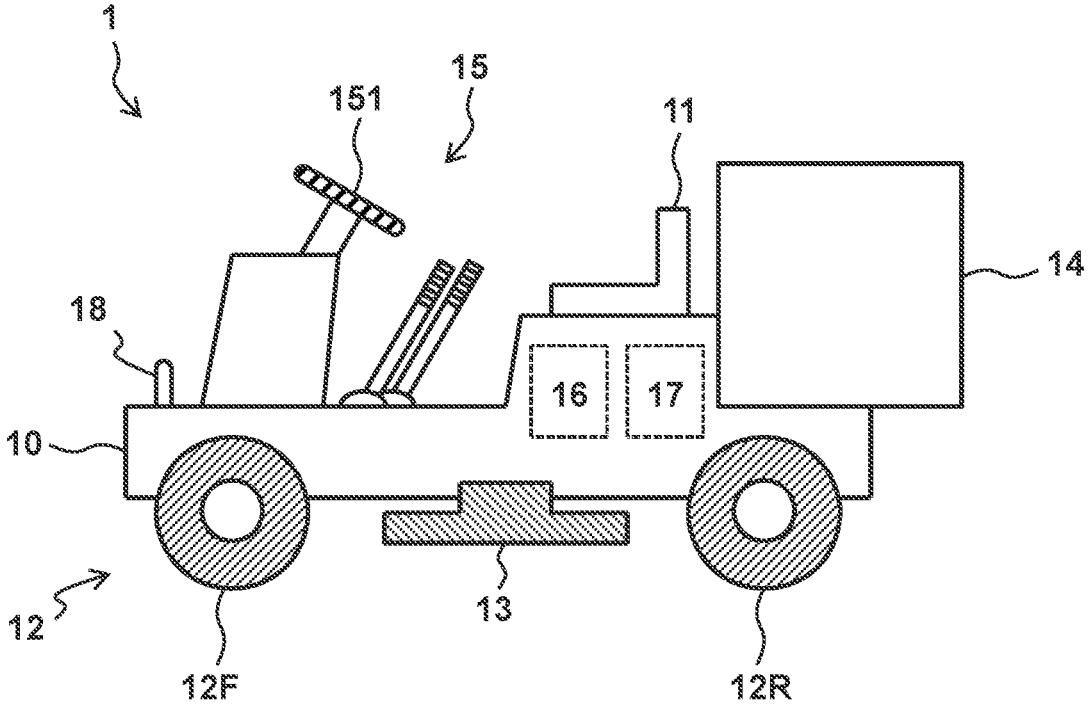
FIG. 2A is a schematic diagram for illustrating an example configuration of a work machine (work vehicle).
Figure 2B:
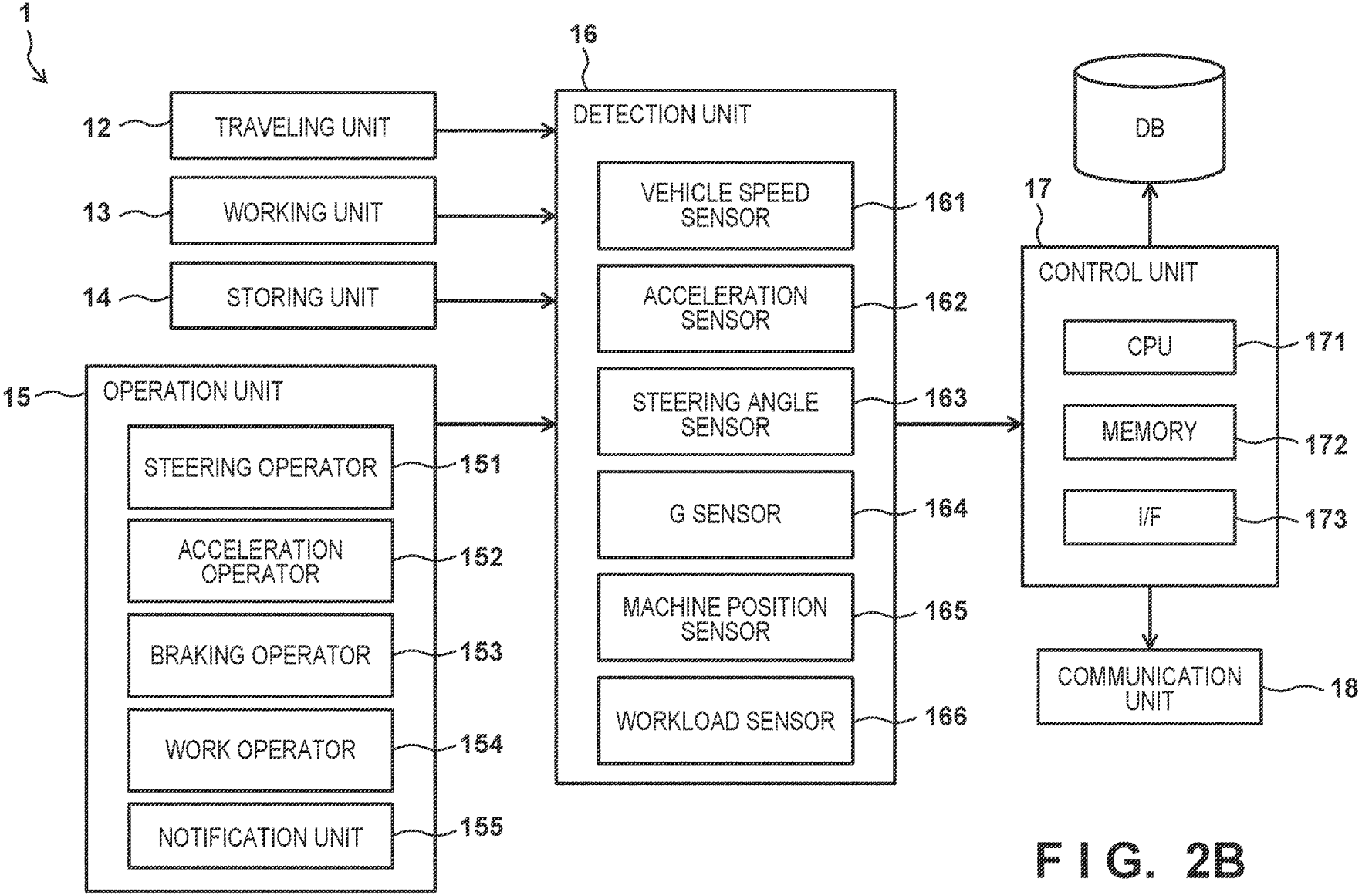
FIG. 2B is a block diagram for illustrating an example configuration of the work machine.

FIG. 2A is a schematic diagram showing an example configuration of the work machine 1. FIG. 2B is a block diagram showing an example configuration of the work machine 1. In the present embodiment, the work machine 1 is a lawn mower that performs the work that is lawn mowing, and is of ride-on type in which a seat 11, on which a worker (user) can sit, is provided on a vehicle body 10. In the present embodiment, the work machine 1 includes a traveling unit 12, a working unit 13, a storing unit 14, an operation unit 15, a detection unit 16, a control unit 17, and a communication unit 18.

The traveling unit 12 is configured to enable the work machine 1 to travel, and is provided below the vehicle body 10 in a state of supporting the vehicle body 10. In the present embodiment, the work machine 1 is a four-wheeled vehicle, and the traveling unit 12 includes a pair of left and right rear wheels 12R serving as drive wheels, and a pair of left and right front wheels 12F serving as driven wheels.

The working unit 13 is provided with a mechanism for executing the work. The working unit 13 in the present embodiment is a lawn mowing blade that is provided below the vehicle body 10, rearward of the front wheels 12F and forward of the rear wheels 12R, and the position of the working unit 13 in the vehicle-body vertical direction can be adjusted. Thus, the lawn mowing blade serving as the working unit 13 can mow the lawn in the work region R and set the height thereof to a desired height.

The storing unit (grass bag) 14 is provided in a rear part of the vehicle body 10, and stores lawn mowed by the lawn mowing blade serving as the working unit 13. The vehicle body 10 is provided with a duct (not shown) extending rearward from above the working unit 13, and the mowed lawn is guided to the storing unit 14 through the duct and is stored in the storing unit 14.

The operation unit 15 includes a plurality or operators 151 to 154 for accepting driving operations from the worker, and the worker performs driving operations using these operators; for example, controls driving of the traveling unit 12, the working unit 13, and so on. A steering operator 151 is an operator for steering the work machine 1, and the worker can cause the work machine 1 to turn left and right and rotate, for example, by changing the direction of the front wheels 12F using the steering operator 151. An acceleration operator 152 is an operator for driving the traveling unit 12, and the worker can cause the work machine 1 to start or accelerate using the acceleration operator 152. A braking operator 153 is an operator for suppressing driving of the traveling unit 12, and the worker can cause the work machine 1 to decelerate or stop using the braking operator 153. A work operator 154 is an operator for driving the working unit 13, and the worker can start or stop the work using the work operator 154. Although a steering wheel is shown as an example of the steering operator 151 in the diagram, any type, such as a lever type, a pedal type, or a switch type, may be employed for the operators 151 to 154.

Note that, although the details will be described later, the operation unit 15 is further provided with a notification unit 155, which makes it possible to notify the worker of information necessary for operations (or relevant information). It is favorable that this notification unit 155 is provided at a position in the operation unit 15 at which the notification unit 155 can readily alert the worker, but additionally/alternatively, the notification unit 155 may be provided at a position spaced apart from the operation unit for example, a position on the side of the seat 11.

The detection unit 16 includes a plurality of sensors 161 to 166 for detecting the states of the work machine 1, for example. A vehicle speed sensor 161 can detect the traveling speed of the work machine 1, and is provided on the traveling unit 12, for example. An acceleration sensor 162 can detect the acceleration of the work machine 1, and is provided on the vehicle body 10, for example. A steering angle sensor 163 can detect an operation amount of the steering operator 151, and is provided on the operation unit 15, for example. A G-sensor 164 can detect the orientation of the vehicle body 10, and is provided on the vehicle body 10, for example. A machine position sensor 165 can detect the position of the work machine 1 in the work region R, and is provided on the vehicle body 10, for example. A workload sensor 166 can detect a workload of the working unit 13 and/or the storing unit 14, and is provided on the vehicle body 10, for example.

In the present embodiment, the control unit 17 is, an ECU (electronic control unit) that includes a CPU 171, a memory 172, and an external communication interface 173. Although the details will be described later, for example, the control unit 17 receives a signal indicating the results of detection by the detection unit 16 and performs predetermined signal processing. The control unit 17 can also reference a database DB that is registered in advance to perform signal processing, for example. The control unit 17 can transmit, using the communication unit 18, information indicating the results of signal processing to the information management apparatus 2. The control unit 17 can also receive, using the communication unit 18, information from the information management apparatus 2. Note that the functions of the control unit 17 are typically realized as a result of two or more ECUs communicating with each other, but may alternatively be realized by a single ECU.

Figure 3A:
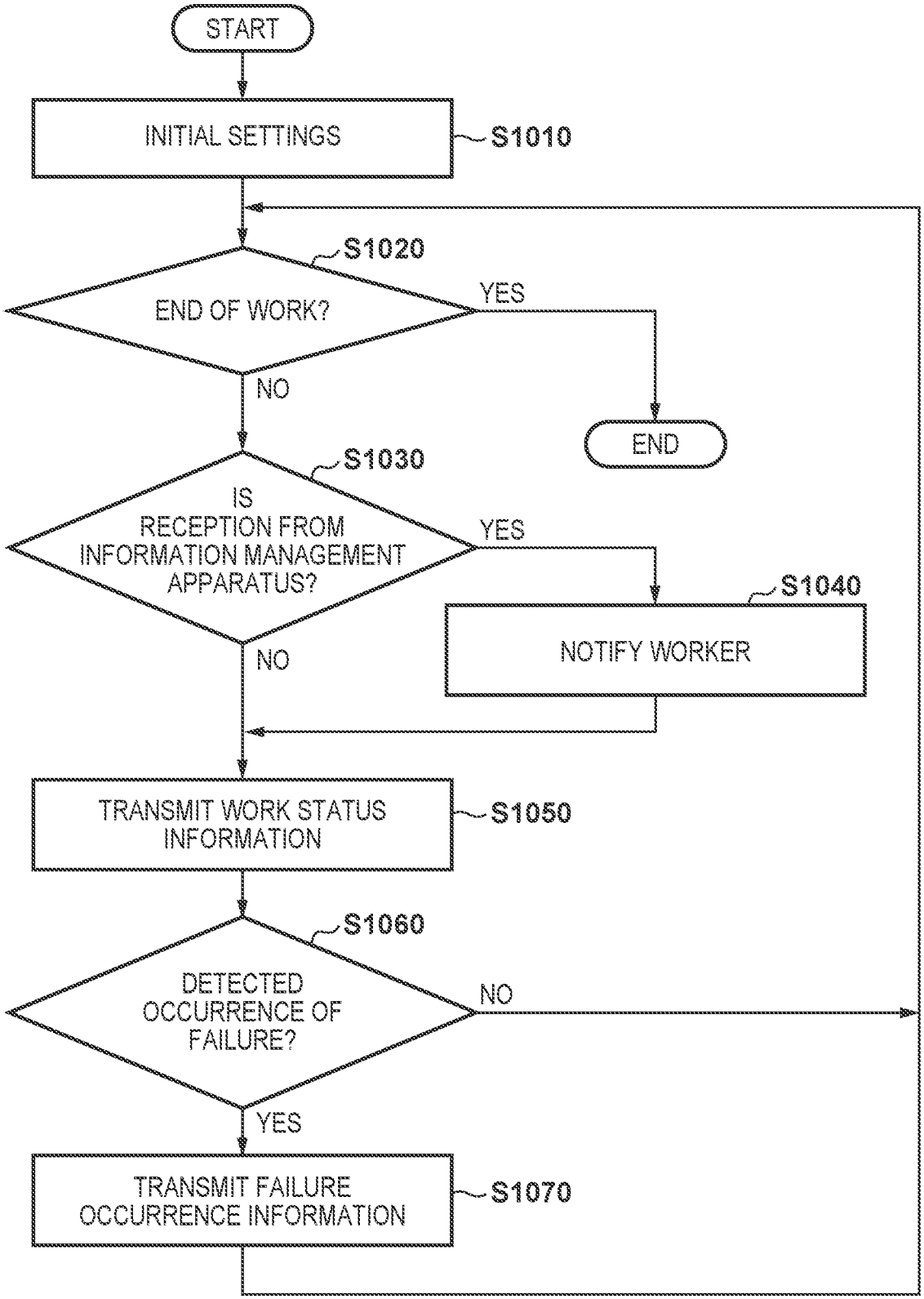
FIG. 3A is a flowchart for illustrative the content of an operation of the work machine.

With the above-described configuration, the work system SY realizes the work in the work region R with the plurality of work machines 1 and the information management apparatus 2 communicating with each other. As an overview thereof, if the information management apparatus 2 receives information indicating an occurrence of a failure from one (e.g., 1A) of the plurality of work machines 1, the information management apparatus 2 transmits information based on this failure to the other work machines (e.g., 1B and 1C), FIG. 3A is a flowchart of the content of an operation performed by each of the plurality of work machines 1 (each of the work machines 1A to 1C). As an overview, after configuring initial settings and starting the work, each work machine 1 regularly transmits information indicating work status to the information management apparatus 2, and if a predetermined failure occurs, the work machine 1 transmits information indicating this failure to the information management apparatus 2. Meanwhile, if any of the work machines 1 receives information based on the failure that has occurred in another work machine 1 from the information management apparatus 2, the former work machine 1 notifies the worker of this information using the notification unit 155. In the following description, the content of the operation will be described focusing on the work machine 1A to simplify the description, but the same applies to the other work machines 1B and 1C.

In step S1010 (hereinafter, simply "S1010"; the same applies to the other steps), initial settings for starting the work are configured, and information associated with the work machine 1A that will join the work is registered in the information management apparatus 2. For example, it is registered that the work machine 1A will perform the work in the assigned region RA and this assigned region RA is a scheduled-travel region, and additionally, a work plan (e.g., information indicating a scheduled-travel path of the work machine 1A etc.) is registered. If necessary, identification information indicating the worker of the work machine 1A may also be registered.

In S1020, whether or not the work has ended is determined. This determination includes not only determination of whether or not the work machine 1A has completed the work in the assigned region RA, but also determination of whether or not to suspend the work (the details will be described later). If the work has ended, this flowchart ends, and if not, the operation proceeds to S1030. Note that, if the work has ended, the work machine 1A may be moved out of the work region R, or the work machine 1A may be stopped at a predetermined position in the assigned region RA, for example.

In S1030, whether or not information has been received from the information management apparatus 2 is determined. Although the details will be described later, in the present embodiment, information based on an occurrence of a failure in the other work machines 1B and/or 1C is provided as recurrence prevention information from the information management apparatus 2 to the work machine 1A in order to prevent an occurrence (recurrence) of a similar failure. If the recurrence prevention information has been received from the information management apparatus 2, the operation proceeds to S1040, and if not, the operation proceeds to S1050.

In S1040, responding to the receipt of the recurrence prevention information in step S1030, a notification based on this information is given to the worker by the notification unit 155. Thus, the worker can be alerted to ensure that a similar failure will not recur.

In S1050, work status information, which indicates work status of the work machine 1A, is transmitted to the information management apparatus 2. In the present embodiment, the work status information includes position information and individual progress information. The position information is information indicating the position (current position) of the work machine 1A in the work region R. The individual progress information is information indicating the degree to which the work in the assigned region RA is complete. The work status information may also include any other information accompanying the above information. The information management apparatus 2 receives the work status information from each work machine 1, generates (or updates) and manages information indicating the work status over the entire work region R serving as work progress information, based on the received work status information.

In S1060, it is determined whether or not an occurrence of a predetermined failure has been detected in the work machine 1A. If an occurrence of a failure has been detected, the operation proceeds to S1070, and if not, the operation returns to S1020.

An example of the failure may be a so-called accident such as contact, interference, or collision between an unforeseen object and the work machine 1A in the assigned region RA, for example. Another example of the failure may be an unforeseen operation that does not follow the driving operation, such as slipping of the work machine TA due to the state of the assigned region RA, for example. Yet another example of the failure may be an abnormal movement due to an early failure or a later failure of each element included in the work machine 1A. That is to say, as for the failure mentioned here, whether or not the vehicle body 10 has been damaged and whether or not the failure has been caused by an external factor do not matter.

An occurrence of the failure can be detected by the detection unit 16 based on some impact being applied to the vehicle body 10, for example. For example, if the acceleration sensor 162 detects a change in the vehicle body in a relatively short time, or if the G-sensor 164 detects a change in the orientation of the vehicle body 10 in a relatively short time, the control unit 17 can determine that some kind of failure, such as the aforementioned accident or unforeseen movement, has occurred.

An occurrence of the failure can also be determined by the control unit 17 referencing the database DB based on a signal from the detection unit 16. For example, the database DB is an onboard database, and is disposed in the vehicle body 10 such that the control unit 17 can access the database DB. The database DB stores, in advance, a look-up table (LUT) or the like in which operation amounts that may be input to the operation unit 15 are associated with movements of the work machine 1A that are expected in correspondence with the operation amounts. The control unit 17 receives a signal indicating an operation amount that has been input to the operation unit 15 from the detection unit 16 (e.g., the steering angle sensor 163 etc.), and receives a signal indicating a movement of the work machine 1A at this time from the detection unit 16 (e.g., the acceleration sensor 163, the G-sensor 164 etc.). Based on these signals, the control unit 17 determines whether or not the movement of the work machine 1A corresponds to the operation amount that has been input to the operation unit 15 (whether or not the movement is within an allowable range) by referencing the database DB. As a result, when the movement of the work machine 1A exceeds the allowable range for the operation amount that has been input to the operation unit 15, the control unit 17 can determine that some kind of failure has occurred in the work machine 1A.

In S1070, in accordance with the determination in S1060 that a failure has occurred, failure occurrence information indicating the occurrence of the failure is transmitted to the information management apparatus 2. In the present embodiment, the failure occurrence information includes failure occurrence position information and driving operation history information. The failure occurrence position information is information indicating the position of the work machine 1 in the work region R at the time of the occurrence of the failure in the work machine 1. The failure occurrence position information is used, for example, to specify the position of an unforeseen object that may have caused the occurrence of the failure. The driving operation history information is information indicating the history of driving operations (e.g., operation history for several seconds to several tens of seconds until the occurrence of the failure was detected) in the work machine 1 that have led to the occurrence of the aforementioned failure. The driving operation history information includes, for example, data indicating the vehicle speed, acceleration, steering angle, or the like before the failure occurred, and is used to specify a movement of the work machine 1 that may have caused the occurrence of the failure. Although the details will be described later, if the information management apparatus 2 receives this failure occurrence information from the work machine 1A, the information management apparatus 2 transmits information based on the received information as recurrence prevention information to the other work machines 1B and 1C.

Figure 3B:
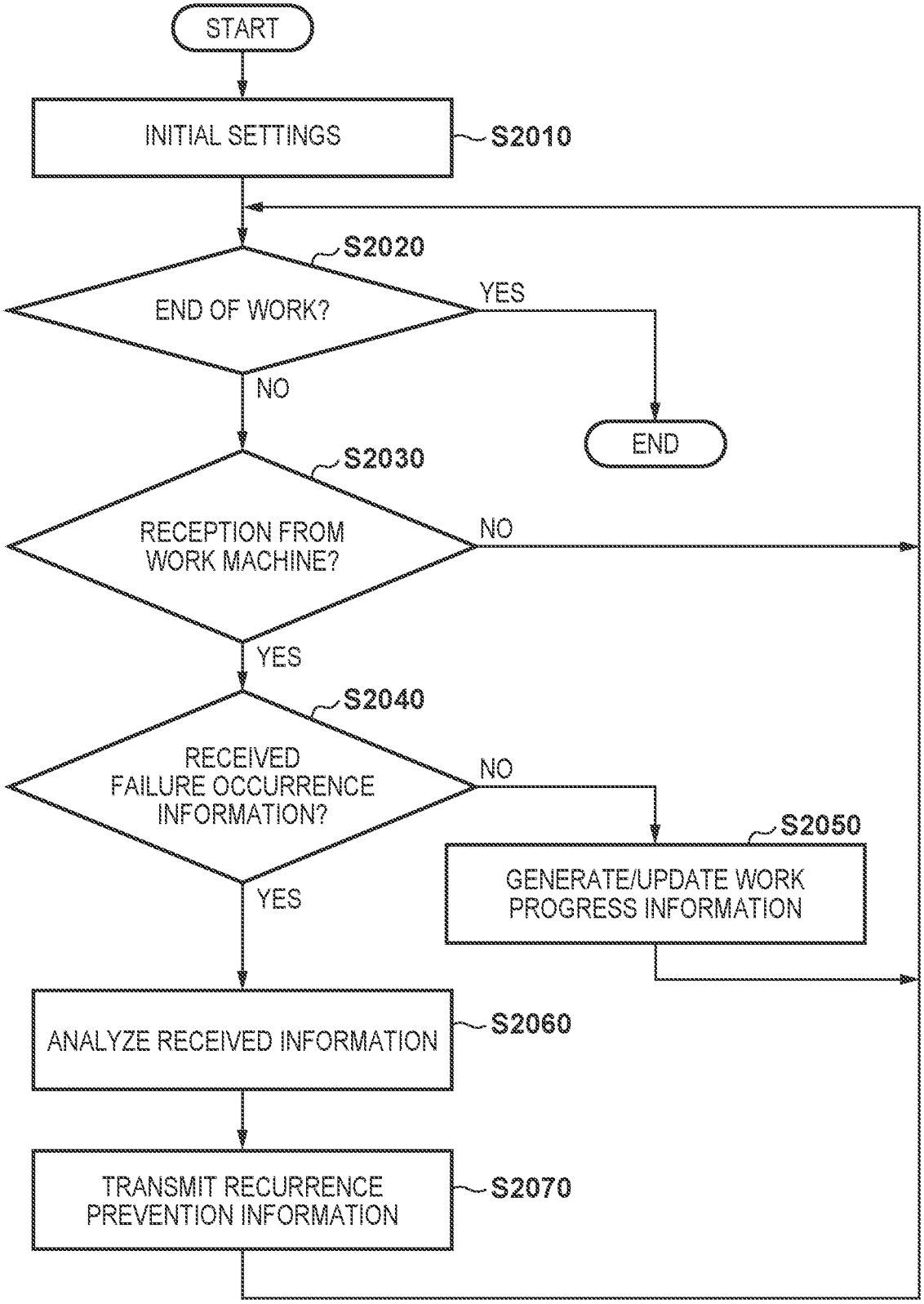
FIG. 3B is a flowchart for illustrating the content of an operation of an information management apparatus.

FIG. 3B is a flowchart of the content of an operation performed in the information management apparatus 2. As an overview, after configuring initial settings, the information management apparatus 2 generates (or updates) and manages the work progress information while regularly receiving the work status information from each work machine 1 that has started the work. Meanwhile, if the information management apparatus 2 receives the failure occurrence information from any work machine 1, the information management apparatus 2 transmits the recurrence prevention information based on the failure occurrence information to the other work machines 1.

In S2010, as initial settings for starting the work, the plurality of work machines 1 that will join the work are registered (see S1010 in FIG. 3A). That is to say, the information management apparatus 2 registers that the work machine 1A will perform the work in the assigned region RA and the assigned region RA is a scheduled-travel region, and also registers similar content for the work machines 1B and 1C.

In S2020, whether or not the work has ended is determined. This determination is performed based on information from each work machine 1. Here, in this embodiment, the information from each work machine 1 is either the work status information or the failure occurrence information in order to simplify the description. If it is determined based on the information from each work machine 1 that all of the plurality of work machines 1 has completed (or suspended) the work, it is determined that the work has ended and the flowchart ends, and if not, the operation proceeds to S2030.

In S2030, it is determined whether or not information (either the work status information or the failure occurrence information) has been received from any of the plurality of work machines 1. If information has been received, the operation proceeds to S2040, and if not, the operation returns to S2020.

In S2040, whether or not the information received in S2030 is the failure occurrence information is determined. If the received information is not the failure occurrence information (i.e., if the received information is the work status information), the operation proceeds to S2050, and if the received information is the failure occurrence information, the operation proceeds to S2060.

As mentioned above, the work status information includes the position information and the individual progress information regarding each work machine 1. In S2050, the information management apparatus 2 generates (or updates) and manages the work progress information based on the work status information received in S2030.

In S2060, the failure occurrence information received in S2030 is analyzed, and the recurrence prevention information based on the failure occurrence information is generated. As mentioned above, the failure occurrence information includes the failure occurrence position information and the driving operation history information. Thus, the information management apparatus 2 can generate, as the recurrence prevention information, information for preventing an occurrence (recurrence) of a similar failure based on the failure occurrence position information and the driving operation history information. The recurrence prevention information may be direct information indicating at which position in the work region R the failure has occurred in which of the work machines 1 due to what type of operation mode, or may be indirect information for preventing a recurrence of a similar failure.

In S2070, the recurrence prevention information generated in S2060 is transmitted to the other work machines 1. As mentioned above (see S1040 in FIG. 3A), the other work machines 1 that have received the recurrence prevention information give the workers a notification based on the received information, using the notification unit 155. Thus, the workers of the other work machines 1 can be alerted such that a similar failure will not recur. For example, the notification unit 155 alerts the workers by notifying the workers that some driving operations are not recommended.

Figure 4:
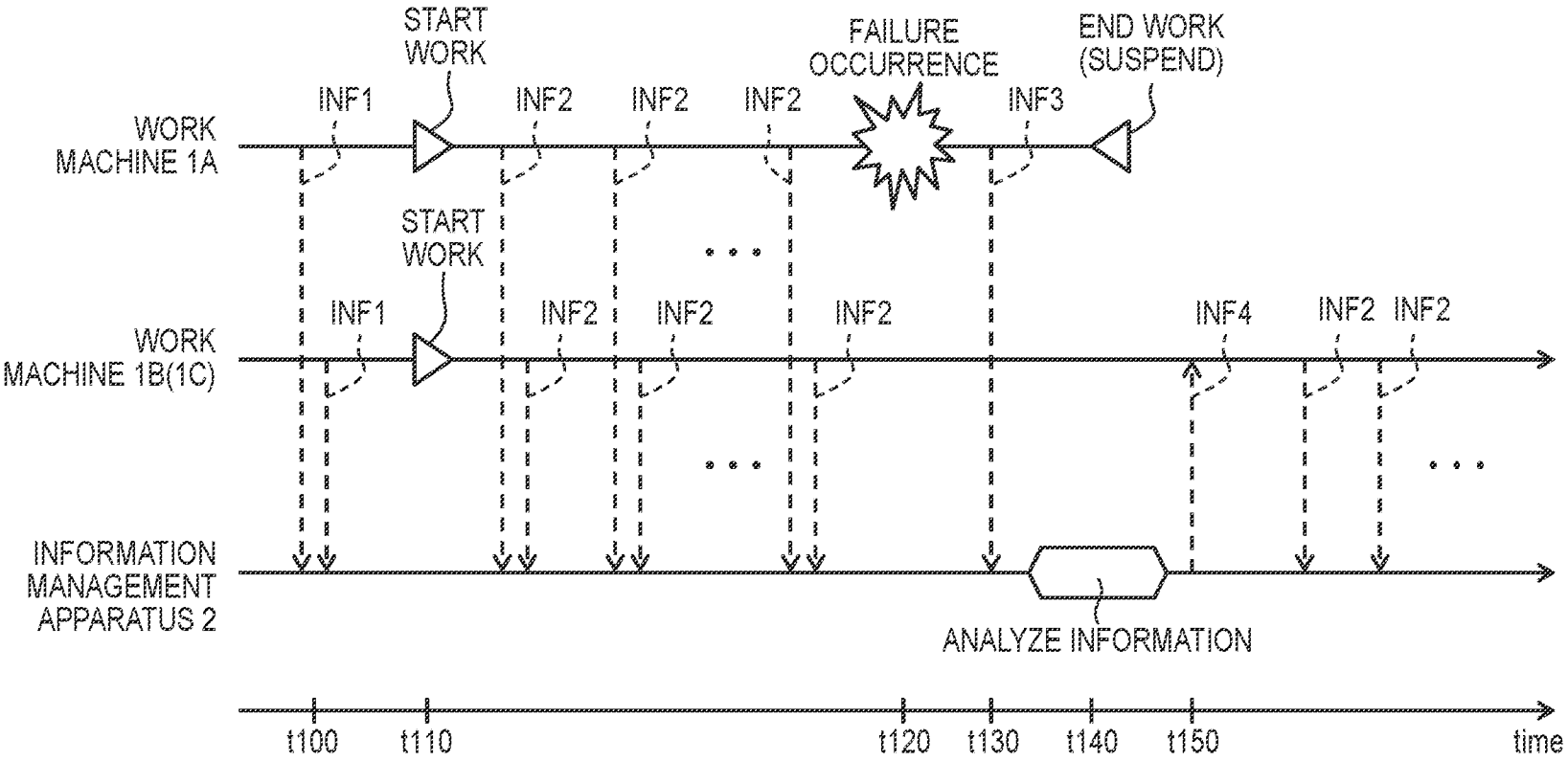
FIG. 4 is a timing chart for illustrating an example of a method for information management.

FIG. 4 shows an example of a mode of exchanging information between the work machines 1A to 1C and the information management apparatus 2. In this example, the case where a failure occurs in the work machine 1A at a certain timing after the work has been started is considered. The other work machines 1B and 1C receives, from the information management apparatus 2, the recurrence prevention information based on the occurrence of the failure in the work machine 1A (the mode of exchanging information in the work machines 1B and 1C is the same, and therefore these work machines are collectively referred to as "work machine 1B (1C)" in the diagram).

First, at a time t100, each of the work machines 1A to 1C transmits registration information INF1 to the information management apparatus 2, and thus configures the aforementioned initial settings (see S1010, S2010 etc.). The registration information INF1 includes, for example, identification information regarding the work machine 1 that will join the work, and information indicating the region assigned to the work machine 1 (one of the assigned regions RA to RC) or the scheduled-travel region. Additionally, the registration information INF1 may also include information indicating a work plan (information indicating a scheduled-travel path), identification information regarding the worker (a person who performs driving operations), or the like.

Thereafter, at a time t110, each work machine 1 starts the work in the corresponding assigned region (one of the assigned regions RA to RC), and thereafter transmits the work status information INF2 to the information management apparatus 2 regularly (e.g., at regular periods, such as every 10 minutes, every 30 minutes, or every one hour). As mentioned above, the work status information INF2 includes the position information and the individual progress information regarding each work machine 1, and the information management apparatus 2 generates (or updates) the work progress information based on the work status information INF2 received from each work machine 1.

It is assumed that a failure occurs in the work machine 1A at a certain timing after the work started, and the time of the failure is a time 1120. In this example, it is assumed that, at the time t120, the work machine 1A comes into contact with an unforeseen object in the assigned region RA. As mentioned above, this can be detected based on signals from the detection unit 16, e.g., from the acceleration sensor 162, the G-sensor 164, or the like.

Also, in this example, it is assumed that the work machine 1A cannot continue the work due to the occurrence of the failure. Whether or not to continue the work can be diagnosed by providing a self-diagnosis function in the work machine 1A, for example. A device that has a self-diagnosis function may be provided as a part of the detection unit 16 or on the vehicle body 10 independently of the detection unit 16, and evaluates, for example, whether or not the traveling unit 12 and the working unit 13 can perform normal movements using a predetermined test pattern, in accordance with the detection of the occurrence of the failure.

It is assumed that, at a time 1130, the work machine 1A transmits, to the information management apparatus 2, the failure occurrence information INF3 indicating that the occurrence of the failure has been detected, and thereafter ends (suspends) the work. As mentioned above, this failure occurrence information INF3 includes the failure occurrence position information and the driving operation history information.

In this example, since the work machine 1A cannot continue the work, the work machine 1A also transmits, to the information management apparatus 2, work end information indicating the end of the work of the work machine 1A as a part of the failure occurrence information INF3 (or separately from the failure occurrence information INF3).

At a time t140, the information management apparatus 2 analyzes the failure occurrence information INF3 received at the time t130. For example, based on the failure occurrence position information, the information management apparatus 2 specifies the presence and the position of an object (a relatively large obstacle (e.g., rock), a region in a relatively poor condition (e.g., swamp) etc.) that may have caused the occurrence of the failure. Also, for example, based on the driving operation history information, the information management apparatus 2 specifies the content of a driving operation that may have caused the occurrence of the failure (a movement of the work machine 1 (e.g., high-speed traveling, sudden acceleration etc.) that may have caused a slip or the like). Also, for example, based on both the failure occurrence position information and the driving operation history information, the information management apparatus 2 specifies which driving operation being performed at which position in the work region R may cause the occurrence of the failure.

The information management apparatus 2 generates the recurrence prevention information INF4 based on the results of the above analysis. If, for example, the occurrence of the failure derives from the position at which the failure occurred and is not associated with the content of the driving operation, information indicating that approach to this position is not recommended is generated as the recurrence prevention information INF4. Also, if, for example, the occurrence of the failure derives from the content of the driving operation and is not associated with the position at which the failure occurred, information indicating that a similar driving operation is not recommended is generated as the recurrence prevention information INF4. Also, if, for example, the occurrence of the failure derives from both the position at which the failure occurred and the content of the driving operation, information indicating that a similar driving operation at the same position and the surrounding area is not recommended is generated as the recurrence prevention information INF4. Note that a similar driving operation refers to operations for causing the work machine 1 to perform movements similar to the movement that led to the occurrence of the failure, and is simply referred to as "a similar driving operation" in some cases in the following description.

At a time t150, the thus-generated recurrence prevention information INF4 is transmitted from the information management apparatus 2 to the other work machines 1B and 1C. Thus, the workers of the other work machines 1B and 1C can appropriately continue the work without a recurrence of a similar failure.

In this example, since the work machine 1A cannot continue the work, the information management apparatus 2 can also transmit information indicating a takeover of the suspended work in the assigned region RA to the other work machines 1B and 1C, based on the work end information received from the work machine 1A. Alternatively, the information management apparatus 2 may transmit information indicating an update of the assignment of the assigned areas RB and RC to the other work machines 1B and 1C. Note that if the work machine 1A can continue the work (e.g., if only a slip or the like occurred as the failure and the traveling unit 12 and the work machine 13 are not damaged), the work machine 1A can resume the work after transmitting the failure occurrence information INF3 to the information management apparatus 2.

According to the present embodiment, the information management apparatus 2 is configured to be able to communicate with the plurality of work machines 1A to 1C. The information management apparatus 2 generates the recurrence prevention information INF4 based on the failure occurrence information INF3 responding to receipt of the failure occurrence information INF3 from any (e.g., the work machine 1A) of the plurality of work machines 1A to 1C. Thereafter, the information management apparatus 2 transmits this recurrence prevention information INF4 to the other work machines (e.g., the work machines 1B and 1C). Thus, information related to the occurrence of the failure can be shared between the work machines 1A to 1C, and a recurrence of a similar failure can be appropriately prevented. This is preferable when the plurality of work machines 1A to 1C performs the work together in the same work region R.

In the present embodiment, the information management apparatus 2 analyzes the failure occurrence information INF3 and generates the recurrence prevention information INF4. However, the analysis itself may alternatively be performed by the work machine 1A in which the failure occurred. For example, the database DB may further store an LUT indicating typical failure cases, in addition to the aforementioned LUT (an LUT indicating movements of the work machine 1A that are expected with respect to the operation amounts input to the operation unit 15). The control unit 17 of the work machine 1A can relatively readily specify the cause of the occurrence of the failure by referencing this database DB.

Second Embodiment

The above first embodiment has described an example of a mode in which the recurrence prevention information INF4 is transmitted to all of the work machines 1 other than the work machine 1 in which a failure occurred, but the recurrence prevention information INF4 may alternatively be transmitted to only some of the other work machines 1 as needed. For example, if a failure occurs in the work machine 1A, the information management apparatus 2 can transmit the recurrence prevention information INF4 to only one of the other work machines 1B and 1C that is highly relevant to the occurrence of the failure, and omit transmission of the recurrence prevention information INF4 to the other one. The other work machine 1A that is highly relevant to the occurrence of the failure may be, for example, a one that is highly likely to be affected by the occurrence of the failure more specifically, one that is located within a predetermined distance from the work machine 1A in which the failure occurred, or the like.

Figure 5:
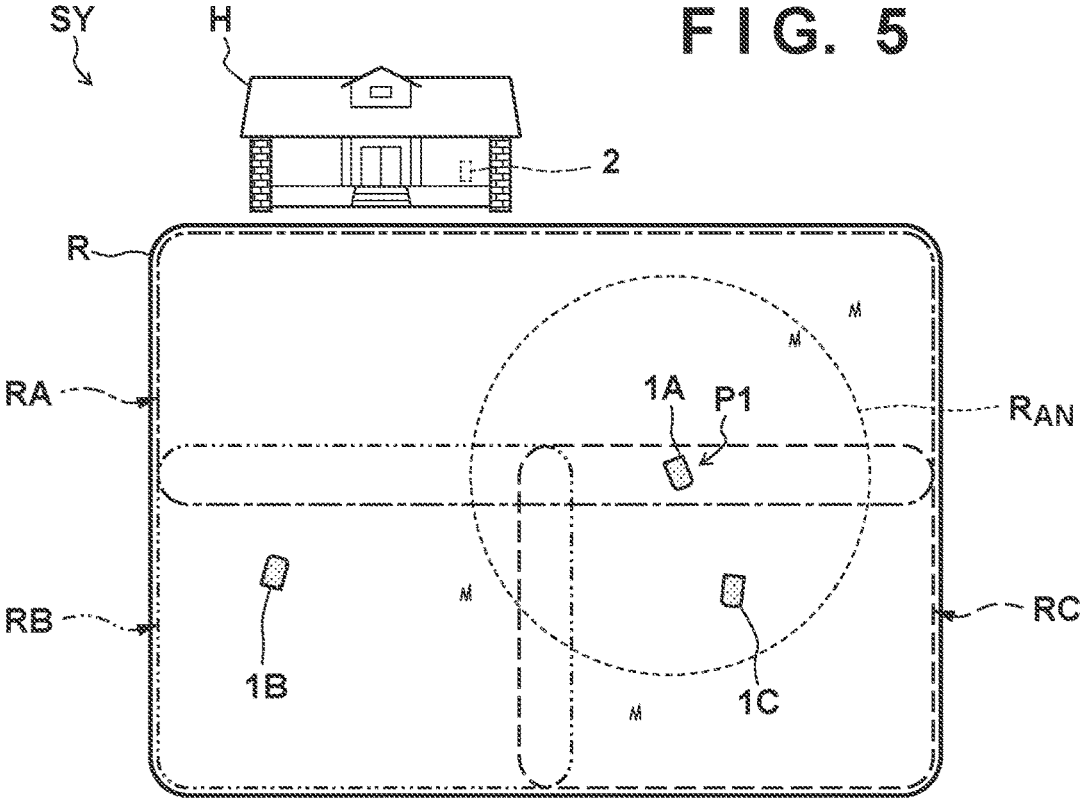
FIG. 5 is a schematic diagram for illustrating a mode of the method for information management.

FIG. 5 shows a work mode of the work system SY according to the second embodiment, similarly to FIG. 1A of the first embodiment. In the present embodiment, it is assumed that a failure has occurred in the work machine 1A at a position P1 in the work region R. Note that, in the present embodiment, the position P1 is in a region in which the assigned regions RA and RC overlap each other, but in another embodiment, the position P1 may be in the assigned region RA and out of the assigned region RC.

The work machine 1A transmits the failure occurrence information INF3 to the information management apparatus 2 based on the occurrence of the failure. This failure occurrence information INF3 includes the failure occurrence position information as also mentioned in the first embodiment, and in the present embodiment, this failure occurrence position information indicates the position P1. Meanwhile, before the occurrence of the failure, the information management apparatus 2 has regularly received, from each work machine 1, the work status information INF2 including the position information thereof as also mentioned in the first embodiment. For this reason, the information management apparatus 2 can specify another work machine 1 that is highly likely to be affected by the occurrence of the failure as a work machine 1 to which the recurrence prevention information INF4 is to be transmitted, based on the work status information INF2 and the failure occurrence information INF3.

In the present embodiment, the work machine 1C is performing the work within a predetermined distance from the work machine 1A, and is highly likely to be affected by the failure that occurred on the work machine 1A. The information management apparatus 2 specifies another work machine 1C that is present in a circular region with the center at the position P1 and the radius that is the predetermined distance in a plan view or a top view, for example, based on the work status information INF2 and the failure occurrence information INF3. Thereafter, the information management apparatus 2 transmits the recurrence prevention information INF4 to the specified work machine 1C, and omits transmission of the recurrence prevention information INF4 to the work machine 1B.

According to the present embodiment, information related to the occurrence of the failure is shared with a work machine 1 that is present relatively close to the work machine 1A, and thus a recurrence of a similar failure can be appropriately prevented. Also, according to the present embodiment, the worker of the work machine 1B that is not highly relevant to the occurrence of the failure will not be unnecessarily confused.

Note that the above first embodiment has described, as an example, the self-position sensor 165 serving as an element for acquiring the position information regarding each work machine 1. As the self-position sensor 165, any of various position sensors such as a GPS (Global Positioning System) and a beacon can be used.

The present embodiment has described, as an example, a mode in which the recurrence prevention information INF4 is transmitted to some of the work machines 1 that are present relatively close to the position P1. However, the recurrence prevention information INF4 may be transmitted to a work machine 1 that satisfies other conditions.

For example, as another embodiment, the recurrence prevention information INF4 may be transmitted only to another work machine 1 whose scheduled-travel region includes the position P1 at which the failure occurred. For example, in the mode in FIG. 5, the position P1 is in the assigned region RA and also in the assigned region RC. Accordingly, the information management apparatus 2 can transmit the recurrence prevention information INF4 to the work machine 1C whose assigned region RC, which is the scheduled-travel region, includes the position P1, and omit transmission of the recurrence prevention information INF4 to the work machine 1B. Thus, it is possible to prevent a recurrence of a similar failure in the work machine 1C that is scheduled to travel through the position P1, at which it is conceivable that an object impeding travel is present, and the surrounding area.

As yet another embodiment, if a specific cause of the occurrence of the failure is specified based on the failure occurrence information INF3, the recurrence prevention information INF4 may be transmitted only to another work machine 1 that is directly associated with this cause. For example, when a plurality of types of work machines 1 (of different models, different manufacturers, etc.) perform work together in the work region R, the information management apparatus 2 can transmit the recurrence prevention information INF4 only to a work machine 1 of the same type. That is to say, a work machine that satisfies a preset condition need only be specified as another work machine 1 that is highly relevant to the occurrence of the failure, and another work machine 1 is not necessarily limited to the above example.

Third Embodiment

The above first embodiment has described that a work machine 1 that has received the recurrence prevention information INF4 gives a notification using the notification unit 155 and thus alerts the worker such that a similar failure will not recur. However, the recurrence prevention information INF4 may also be used to limit some movements of the work machine 1 in addition to alerting the worker.

Figure 6:
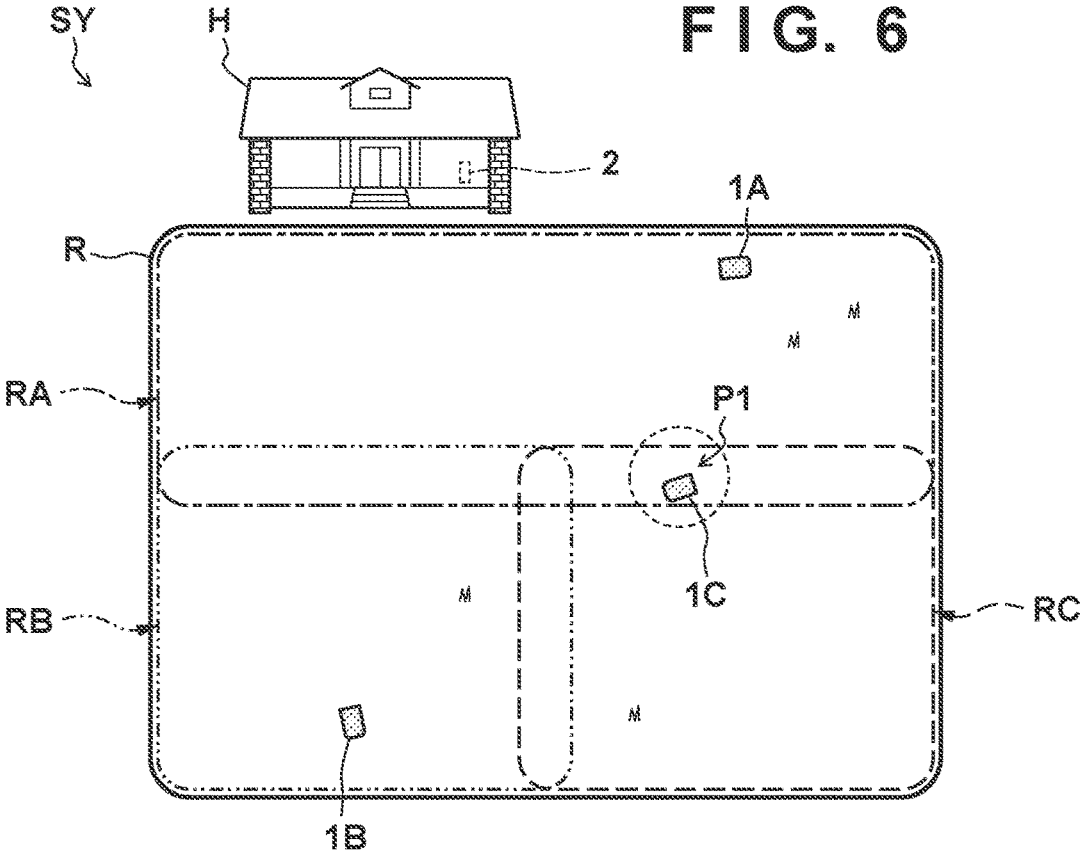
FIG. 6 is a schematic diagram for illustrating a mode of the method for information management.

FIG. 6 shows a work mode of the work system SY according to the third embodiment. In the present embodiment, it is assumed that a failure occurs in the work machine 1A at the position P1 in the work region R, the failure occurrence information INF3 is transmitted from the work machine 1A to the information management apparatus 2, and thereafter the work machine 1A continues the work. That is to say, in the present embodiment, simple slipping occurs as a failure, and thus the traveling unit 12 and the working unit 13 are not damaged. It is also assumed that, thereafter, another work machine 1C approaches the position P1.

As also mentioned in the above second embodiment, the recurrence prevention information INF4 is transmitted by the information management apparatus 2 to the work machine 1C whose assigned region RC, which is the scheduled-travel region, includes the position P1. In the present embodiment, in order to prevent a recurrence of a similar failure due to a driving operation similar to that of the work machine 1A being performed by the work machine 1C, information for restricting execution of the similar driving operation at the position P1 and the surrounding area is transmitted as the recurrence prevention information INF4 to the work machine 1C. Thus, even if the worker of the work machine 1C performs a driving operation similar to the driving operation which led to the occurrence of the failure, the work machine 1C does not execute a movement corresponding to this driving operation.

As an example, an operation amount of the steering operator 151 at the time of the occurrence of the failure in the work machine 1A is denoted as WA1, and an operation amount of the acceleration operator 152 at this time is denoted as WA2. In this case, if the worker of the work machine 1C inputs an operation amount WC2 (≥WA2) of the acceleration operator 152 while inputting an operation amount WC1 (≥WA1) of the steering operator 151, there is a possibility that a similar failure will occur in the work machine 1C. Thus, if such a driving operation is input, execution restriction information indicating that execution of this driving operation is to be restricted is transmitted as the recurrence prevention information INF4 to the work machine 1C.

In the above example, it is favorable that the execution restriction information for restricting execution of a driving operation in which the operation amount of the steering operator 151 is WA1×K1 or more and the operation amount of the acceleration operator 152 is WA2×K2 or more is transmitted as the recurrence prevention information INF4. Both K1 and K2 above are coefficients that are more than 0 and 1 or less.

Here, as mentioned above, the failure occurrence information INF3 includes the driving operation history information, in addition to the failure occurrence position information. Accordingly, the execution restriction information serving as the recurrence prevention information INF4 can be generated based on this driving operation history information by the information management apparatus 2.

According to the present embodiment, at the position P1 at which a failure occurred in the work machine 1A, another work machine 1C is restrained from executing a driving operation similar to a driving operation that led to the occurrence of the failure, and thus a similar failure can be prevented from recurring in the work machine 1C. The restriction indicated by the execution restriction information serving as the recurrence prevention information INF4 is a partial restriction, and corresponds to, for example, causing a work machine to travel at a lower vehicle speed than the original vehicle speed corresponding to an operation amount that is actually input to the acceleration operator 152. Meanwhile, as another example, all operations may be restricted.

In these examples, to make the worker of the work machine 1C feel less uncomfortable during the driving operation, it is favorable that the worker of the work machine 1C is notified by the notification unit 155 that execution of some driving operations is restricted. The above configuration is preferable when an occurrence of a failure drives from both the position P1 at which the failure occurred and the content of a driving operation.

As another embodiment, if an occurrence of a failure derives from the content of a driving operation and is not related to the position at which the failure occurred, execution of a similar driving operation may be restricted irrespective of the position of the work machine 1C. In this case, it is favorable that the execution restriction information serving as the recurrence prevention information INF4 is also transmitted to the work machine 1B.

As yet another embodiment, the information management apparatus 2 can also transmit the execution restriction information serving as the recurrence prevention information INF4 to the work machine 1A. In the example in FIG. 6, the work machine 1A detects an occurrence of a failure, transmits the failure occurrence information INF3 to the information management apparatus 2, and then continues the work. For this reason, it is favorable that the execution restriction information is also transmitted to the work machine 1A such that a similar driving operation is not performed again by the work machine 1A and a similar failure does not recur.

Fourth Embodiment

The above first to third embodiments have described the case where an occurrence of a failure derives from a position (e.g., the position P1) and the case where it derives from the content of a driving operation. Meanwhile, as for the work machines 1, whether or not a similar failure readily occur also depends on the workload of the work machines 1.

In the case of a lawn mower serving as the work machine 1 (see FIG. 2A), examples of the workload include, for example, the amount of accumulated lawn that has been mowed by the working unit 13 (i.e., the weight of the storing unit 14), the weight of a passenger who sits on the seat 11, the total weight of the work machine 1, or the like. Other examples of the workload include, for example, the type of the working unit 13 (the type of a lawn mowing blade), the state thereof (the degree of degradation with cumulative use), or the like. Yet other examples of the workload include, for example, ease of travel using the traveling unit 12, the state of the work region R (the presence of a slope angle and unevenness of a traveling surface), or the like. The workload can be measured by the workload sensor 166.

In the fourth embodiment, if a failure occurs, the work machine 1A also transmits, to the information management apparatus 2, workload information indicating the aforementioned workload as a part of the failure occurrence information INF3 (or separately from the failure occurrence information INF3). Then, the information management apparatus 2 transmits, to the work machines 1B and 1C, execution restriction information for restricting execution of a similar driving operation in a state with a workload corresponding to the workload information as the recurrence prevention information INF4.

As an example, the workload of the work machine 1A at the time of the occurrence of the failure in the work machine 1A is denoted as LD1. In this case, if the worker of the work machine 1B or 1C performs a driving operation similar to that of the work machine 1A in a state where the work machine 1B or 1C has a workload LD2 (≥LD1), there is a possibility that a similar failure will occur in the work machine 1B or 1C. For this reason, the execution restriction information indicating that execution of the similar driving operation is to be restricted in a state with a workload that is greater than or equal to a reference is transmitted as the recurrence prevention information INF4 to the work machines 1B and 1C.

In the above example, it is favorable that the execution restriction information for restricting execution of a similar driving operation in a state where the workload is LD1×K3 or more is transmitted as the recurrence prevention information INF4. K3 above is a coefficient that is more than 0 and 1 or less.

According to the present embodiment, another work machine 1C that has a workload similar to that of the work machine 1A in which a failure occurred is restrained from executing a driving operation similar to the driving operation that led to the occurrence of the failure, and thus a similar failure can be prevented from recurring in the work machine 1C.

Fifth Embodiment

The above third and fourth embodiments have described prevention of a recurrence of a similar failure by using, as the recurrence prevention information INF4, the execution restriction information indicating that execution of some driving operations is to be restricted. Meanwhile, the method for preventing a recurrence of a failure is not limited to these examples.

The failure occurrence information INF3 transmitted from the work machine 1 in which a failure occurred to the information management apparatus 2 may also include additional information that may be associated with the cause of the occurrence of the failure, in addition to the failure occurrence position information and the driving operation history information. An example of the additional information is information indicating motion characteristics of the work machine 1. The information indicating motion characteristics may be any of the parameters indicating the states of vehicle travel control, such as an output mode of an engine (e.g., engine speed, throttle position) and the state of a transmission.

In the fifth embodiment, a recurrence of a failure is prevented by restricting motion characteristics of the work machine 1 based on the additional information, instead of restricting execution of some driving operations. For example, if a failure occurs in the work machine 1A, a recurrence of a similar failure is made difficult in the work machines 1B and 1C by making the motion characteristics of the other work machines 1B and 1C lower than those of the work machine 1A. Such restriction of motion characteristics can be realized by, for example, changing the mode of controlling the engine speed and the throttle position, and can also be realized by changing the mode of controlling the time required to change the speed and the timing of changing the speed in the transmission. Also, according to the present embodiment, the worker of the work machine 1B or 1C may feel less uncomfortable when performing a driving operation than in the above third and fourth embodiments in which execution of some driving operations is restricted. Accordingly, according to the present embodiment, the operability of the work machines 1 can be improved in addition to making it possible to appropriately prevent a recurrence of a failure.

Others

Although some preferable embodiments have been described as examples, the present invention is not limited to these examples and may be modified without departing from the gist of the present invention. The embodiments may be partially modified, or two or more of the embodiments may be combined.

For example, in the embodiments, sharing of the information for preventing a recurrence of a failure between the plurality of work machines 1 is realized by the information management apparatus 2. However, the functions of the information management apparatus 2 may be provided in each work machine 1. In this case, each work machine 1 directly exchanges information with the other work machines 1. Communication between the work machines 1 in this case can be realized by using a known wireless communication technology, such as Bluetooth (registered trademark).

Although the embodiments have described, as an example, the work machines 1 of a ride-on type on which the workers can sit, the work machines 1 may alternatively be of a walking type that is manually pushed by the operator while walking, or may be of an unmanned traveling type that performs work without an operator. Note that, in the case of the unmanned traveling type, the work is executed through automated driving in which operations of the operation unit 15 is performed by the control unit 17. Accordingly, it can be said that the content of the embodiments is also applicable to a work machine that can perform automated driving or driving assistance.

Examples of the work machines 1 include not only a lawn mower that is taken as an example in the embodiments, but also a snow blower for performing snow removal as work, an agricultural work machine (e.g., cultivator), or the like. In addition, the content of the embodiments is also applicable to vehicles that can be used for various purposes, such as a construction vehicle and a transportation vehicle. A typical example of the vehicles is a four-wheeled vehicle (or a two-wheeled vehicle, three-wheeled vehicle etc.), but the concept of the vehicles may include various types of vehicles such as a vehicle equipped with a crawler type traveling body or the like, in addition to a vehicle that travels using wheels.

Each of the terms used in the present specification is merely used for the purpose of describing the present invention. Needless to say, the present invention is not limited to strict meanings of the term and may also encompasses an equivalent thereto. For example, the information INF1 and so on that is exchanged between two or more elements may also be expressed as a signal, a command, or the like.

SUMMARY OF EMBODIMENTS

A first mode relates to an information management apparatus (e.g., 2). The information management apparatus is an information management apparatus capable of communicating with a plurality of vehicles (e.g., 1, 1A to 1C) and includes: a receiving unit (e.g., 23, S2030 to S2040) for receiving information (e.g., INF3) indicating an occurrence of a failure in one vehicle (e.g., 1A) of the plurality of vehicles, from the one vehicle; and a transmission unit (e.g., 23, S2070) for transmitting information (e.g., INF4) based on the failure to the other vehicles (e.g., 1B, 1C) of the plurality of vehicles.

According to the first embodiment, if a failure occurs in a certain vehicle, information regarding the occurrence of the failure can be shared with other vehicles, and it is thus possible to appropriately prevent an occurrence (recurrence) of a similar failure. Note that examples of the failure include an accident (e.g., collision), an unforeseen movement (e.g., slipping), an abnormal movement (e.g., early failure/later failure), or the like, and whether or not the vehicle body is damaged and whether or not the failure has been caused by an external factor, for example, do not matter.

In a second mode, a registration unit (e.g., S2010) for registering vehicles traveling in a predetermined region (e.g., R) as the plurality of vehicles is further provided, and the receiving unit receives the information indicating the occurrence of the failure in the one vehicle in the predetermined region, and the transmission unit transmits the information based on the failure to the other vehicles in the predetermined region.

According to the second mode, a recurrence of a similar failure in a predetermined region can be appropriately prevented by sharing the information between vehicles traveling in the predetermined region.

In a third mode, the vehicles registered by the registration unit are work machines (e.g., 1) each including a working unit (e.g., 13), and the predetermined region is a work region (e.g., R) for the work machines.

According to the third mode, a recurrence of a similar failure in a predetermined work region can be appropriately prevented by sharing the information between a plurality of work machines that perform work together in the work region.

In a fourth mode, the receiving unit further receives position information (e.g., INF2) indicating a position of each vehicle in the predetermined region from the plurality of vehicles (e.g., S1050, S2030), and the transmission unit transmits the information based on the failure to the other vehicles that are located in a predetermined distance from the one vehicle when the failure occurs, of the plurality of vehicles (e.g., see S2070, FIG. 5).

According to the fourth mode, a recurrence of a similar failure can be appropriately prevented by sharing the information between vehicles that are present relatively close to the position at which the failure occurred.

In a fifth mode, the information received by the receiving unit from the one vehicle when the failure occurs includes failure occurrence position information (e.g., INF3) indicating a position of the one vehicle in the predetermined region.

According to the fifth mode, it is possible to specify the position that is considered to be one at which an object that impedes traveling of vehicles is present.

In a sixth mode, the receiving unit further receives information (e.g., INF1) indicating a scheduled-travel region of each vehicle from the plurality of vehicles (e.g., S1010, S2010), and the transmission unit transmits the information based on the failure to the other vehicles whose scheduled-travel region includes the position indicated by the failure occurrence position information, of the plurality of vehicles (e.g., S2070).

According to the sixth mode, a recurrence of a similar failure can be appropriately prevented by sharing the information between vehicles that are scheduled to travel through the position that is considered to be one at which an object that impedes traveling of the vehicles is present, and the surrounding area. Note that this is also advantageous in the case of a vehicle that performs automated driving/driving assistance.

In a seventh mode, the receiving unit further receives, from the one vehicle, driving operation history information (e.g., INF3) indicating history of a driving operation of the one vehicle that has led to the occurrence of the failure.

According to the seventh mode, it is possible to specify what kind of driving operation may cause a failure.

In an eighth mode, the transmission unit transmits, as the information based on the failure, information for restricting execution of some driving operations based on the driving operation history information, to the other vehicles (e.g., S2070).

According to the eighth mode, a recurrence of a similar failure in the other vehicles can be appropriately prevented by at least partially restricting execution of a driving operation that may cause a failure in the other vehicles.

In a ninth mode, the information received by the receiving unit from the one vehicle when the failure occurs includes failure occurrence position information (e.g., INF3) indicating a position of the one vehicle in the predetermined region, and the transmission unit transmits, as the information based on the failure, information (e.g., INF4) for restricting execution of some driving operations based on the driving operation history information at the position (e.g., P1) indicated by the failure occurrence position information and in a surrounding area, to the other vehicles.

According to the ninth mode, a recurrence of a similar failure in the other vehicles can be more appropriately prevented by at least partially restricting execution of a similar driving operation in the other vehicles at the position at which a failure occurred and the surrounding area.

In a tenth mode, the transmission unit further transmits, as the information based on the failure, information (e.g., INF4) for restricting execution of some driving operations based on the driving operation history information, to the one vehicle.

According to the tenth mode, a recurrence of a similar failure in the same vehicle can be appropriately prevented.

In an eleventh mode, when the plurality of vehicles are a plurality of work machines (e.g., 1, 1A to 1C), the one vehicle is one work machine (e.g., 1A), and the other vehicles are the other work machines (e.g., 1B 1C), the receiving unit receives, from the one work machine, failure occurrence position information indicating a position of the one work machine when the failure occurs, and driving operation history information indicating history of a driving operation of the one work machine that has led to the occurrence of the failure (e.g., S2030 to S2040, INF3), and the transmission unit transmits, as the information based on the failure, information for restricting execution of some driving operations based on the driving operation history information at the position indicated by the failure occurrence position information and in a surrounding area, to the other work machines (e.g., S2070, INF4).

According to the eleventh mode, a recurrence of a similar failure in the other work machines can be more appropriately prevented by at least partially restricting execution of a similar driving operation in the other work machines at the position at which a failure occurred and the surrounding area.

In a twelfth mode, the receiving unit further receives, from the one work machine, workload information (e.g., INF3) indicating a workload of the one work machine at the time of the occurrence of the failure, and the transmission unit transmits, as the information based on the failure, information (e.g., INF4) for restricting execution of some driving operations based on the driving operation history information in a state with a workload corresponding to the workload information, to the other work machines.

According to the twelfth mode, a recurrence of a similar failure in the other work machines can be more appropriately prevented by at least partially restricting execution of a similar driving operation in a state with a workload that is greater than or equal to a reference.

In a thirteenth mode, the receiving unit further receives, from the one vehicle, information indicating motion characteristics of the one vehicle at the time of the occurrence of the failure (e.g., INF3).

According to the thirteenth mode, a recurrence of a similar failure can be more appropriately prevented.

A fourteenth mode relates to a vehicle (e.g., 1). The vehicle is configured to be capable of communicating with other vehicles, and includes: a detection unit (e.g., 16) for detecting an occurrence of a failure; and a communication unit (e.g., 18) for transmitting information based on a result of detection by the detection unit to the other vehicles.

According to the fourteenth mode, if a failure occurs in a certain vehicle, information regarding the occurrence of the failure can be shared with the other vehicles, and it is thus possible to appropriately prevent a recurrence of a similar failure. Note that information may be indirectly transmitted to the other vehicles via the information management apparatus, or may be directly transmitted without via the information management apparatus.

In a fifteenth mode, the vehicle is a work machine (e.g., 1A) that performs work in a predetermined work region (e.g., R), and the communication unit is configured to communicate with other work machines (e.g., 1B, 1C) that perform work together in the predetermined work region.

According to the fifteenth mode, a recurrence of a similar failure in a predetermined work region can be appropriately prevented by sharing the information between a plurality of work machines that perform work together within the work region.

In a sixteenth mode, the detection unit performs the detection based on an impact applied to a vehicle body (e.g., 162, 164).

According to the sixteenth mode, an accident, an unforeseen movement, an abnormal movement, or the like can be detected.

In a seventeenth mode, an operation unit (e.g., 15) for accepting a driving operation from a user is further provided, and if a movement of the vehicle exceeds an allowable range for an operation amount that is input to the operation unit, the detection unit assumes that the failure occurs and performs the detection (e.g., S1060).

According to the seventeenth anode, an accident, an unforeseen movement, an abnormal movement, or the like can be detected. Note that the allowable range may be preset, and can be realized by referencing an onboard database in which an LUT or the like is stored, for example.

In an eighteenth mode, a notification unit (e.g., 155) for notifying a user that some driving operations are not recommended, based on information received by the communication unit from the other vehicles, is further provided.

According to the eighteenth mode, a recurrence of a similar failure can be appropriately prevented.

A nineteenth mode relates to a method for managing information. The method is a method for managing information by communicating with a plurality of vehicles (e.g., 1, 1A to 1C), and includes: a receiving step (e.g., S2030 to S2040) of receiving information (e.g., INF3) indicating an occurrence of a failure in one vehicle (e.g., 1A) of the plurality of vehicles, from the one vehicle; and a transmission step (e.g., S2070) of transmitting information (e.g., INF4) based on the failure to the other vehicles (e.g., 1B, 1C) of the plurality of vehicles.

According to the nineteenth mode, if a failure occurs in a certain vehicle, information regarding the occurrence of the failure can be shared with the other vehicles, and it is thus possible to appropriately prevent a recurrence of a similar failure. Note that this may be realized by supplying a program to a predetermined computer via a network or a storage medium, and loading and executing the program using a processor of the computer.

The present invention is not limited to the above embodiments and various changes and modifications can be made within the spirit and scope of the present invention. Therefore, to apprise the public of the scope of the present invention, the following claims are made.

The invention claimed is:

1. An information management apparatus capable of communicating with a plurality of work machines each including a working unit, the apparatus comprising:

a registration unit for registering work machines traveling in a predetermined region as the plurality of work machines;

a receiving unit for receiving information indicating an occurrence of a failure in one work machine of the plurality of work machines, from the one work machine; and a transmission unit for transmitting information based on the failure to the other work machines of the plurality of work machines, wherein the receiving unit receives the information indicating the occurrence of the failure in the one work machine in the predetermined region, as failure occurrence information, the transmission unit transmits the information based on the failure to the other work machines in the predetermined region, as recurrence prevention information, and the failure occurrence information includes driving operation history information indicating history of a driving operation of the one work machine that has led to the occurrence of the failure.

2. The information management apparatus according to claim 1, wherein the transmission unit transmits, as the recurrence prevention information, information for restricting execution of some driving operations based on the driving operation history information, to the other work machines.

3. The information management apparatus according to claim 1, wherein the predetermined region is a work region for the work machines.

4. The information management apparatus according to claim 1, wherein the receiving unit further receives, from the plurality of work machines, position information indicating a position of the corresponding work machine in the predetermined region, and the transmission unit transmits the recurrence prevention information to the other work machines that are located in a predetermined distance from the one work machine when the failure occurs, of the plurality of work machines.

5. The information management apparatus according to claim 1, wherein the failure occurrence information includes failure occurrence position information indicating a position of the one work machine vehicle in the predetermined region.

6. The information management apparatus according to claim 5, wherein the receiving unit further receives, from the plurality of work machines, information indicating a scheduled-travel region of the corresponding work machine, and the transmission unit transmits the recurrence prevention information to the other work machines whose scheduled-travel region includes the position indicated by the failure occurrence position information, of the plurality of work machines.

7. The information management apparatus according to claim 5, wherein the transmission unit transmits, as the recurrence prevention information, information for restricting execution of some driving operations based on the driving operation history information at the position indicated by the failure occurrence position information and in a surrounding area, to the other work machines.

8. The information management apparatus according to claim 5, wherein the transmission unit further transmits, as the recurrence prevention information, information for restricting execution of some driving operations based on the driving operation history information, to the one work machine.

9. The information management apparatus according to claim 7, wherein the failure occurrence information includes workload information indicating a workload of the one work machine at the time of the occurrence of the failure, and the transmission unit transmits, as the recurrence prevention information, information for restricting execution of some driving operations based on the driving operation history information in a state with a workload corresponding to the workload information, to the other work machines.

10. The information management apparatus according to claim 1, wherein the failure occurrence information includes information indicating motion characteristics of the one work machine at the time of the occurrence of the failure.

11. A method for managing information by communicating with a plurality of work machines each including a working unit, the method comprising:

a registration step for registering work machines traveling in a predetermined region as the plurality of work machines;

a receiving step of receiving information indicating an occurrence of a failure in one work machine of the plurality of work machines, from the one work machine; and a transmission step of transmitting information based on the failure to the other work machines of the plurality of work machines, wherein in the receiving step, the information indicating the occurrence of the failure in the one work machine in the predetermined region is received as failure occurrence information, in the transmission step, the information based on the failure to the other work machines in the predetermined region is transmitted as recurrence prevention information, and the failure occurrence information includes driving operation history information indicating history of a driving operation of the one work machine that has led to the occurrence of the failure.

* * * * *